US007934885B2

(12) United States Patent
Fournier

(10) Patent No.: US 7,934,885 B2
(45) Date of Patent: May 3, 2011

(54) REINFORCED GROUND COVER MATS

(75) Inventor: Robert Fournier, Edmonton (CA)

(73) Assignee: Maxximat Inc., Nisku, Alberta (CA)

( * ) Notice: Subject to any disclaimer, the term of this patent is extended or adjusted under 35 U.S.C. 154(b) by 0 days.

(21) Appl. No.: 12/233,257

(22) Filed: Sep. 18, 2008

(65) Prior Publication Data

US 2009/0087261 A1 Apr. 2, 2009

(30) Foreign Application Priority Data

Sep. 28, 2007 (CA) ..... 2604642

(51) Int. Cl.
*E01C 9/08* (2006.01)
*E01C 5/00* (2006.01)

(52) U.S. Cl. ..... 404/35; 404/41; 404/40

(58) Field of Classification Search ..... 404/35, 404/41; 14/69.5, 73, 74; 52/455, 456, 457, 52/473, 656.1, 656.8, 122.1, 124.2, 125.1, 52/125.2; 15/215, 238
See application file for complete search history.

(56) References Cited

U.S. PATENT DOCUMENTS

| | | | | |
|---|---|---|---|---|
| 2,315,180 A | | 3/1943 | Arthur | |
| 2,382,789 A | * | 8/1945 | Guignon, Jr. | 404/36 |
| 2,737,093 A | | 3/1956 | Greulich | |
| 3,602,110 A | | 8/1971 | Wiggins | |
| 4,462,712 A | | 7/1984 | Penland, Sr. | |
| 4,600,336 A | | 7/1986 | Waller, Jr. | |
| 4,600,337 A | * | 7/1986 | Sarver | 404/35 |
| 4,891,920 A | * | 1/1990 | Pingston | 52/145 |
| 4,925,226 A | * | 5/1990 | Leonard et al. | 294/82.1 |
| 4,992,005 A | * | 2/1991 | Hilfiker | 405/284 |
| 5,087,149 A | | 2/1992 | Waller, Jr. | |
| 5,603,134 A | * | 2/1997 | Whipkey et al. | 14/2.4 |
| 5,924,152 A | * | 7/1999 | Maier | 14/2.4 |
| 6,214,428 B1 | * | 4/2001 | Henderson | 428/54 |
| 6,695,527 B2 | | 2/2004 | Seaux et al. | |
| 6,981,818 B1 | * | 1/2006 | Lange | 404/73 |
| 7,160,055 B2 | * | 1/2007 | Beamish et al. | 404/36 |
| 7,364,383 B2 | * | 4/2008 | Fletcher et al. | 404/35 |
| 7,604,431 B2 | * | 10/2009 | Fournier | 404/35 |
| 2004/0141809 A1 | * | 7/2004 | Wagstaff | 404/35 |
| 2009/0064611 A1 | * | 3/2009 | Hall et al. | 52/236.9 |

FOREIGN PATENT DOCUMENTS

| | | |
|---|---|---|
| CA | 1285166 | 6/1991 |
| CA | 2348328 | 2/2002 |
| CA | 2364968 | 6/2003 |
| GB | 2390388 | 7/2004 |

* cited by examiner

*Primary Examiner* — Thomas B Will
*Assistant Examiner* — Abigail A Risic
(74) *Attorney, Agent, or Firm* — Bennett Jones LLP

(57) ABSTRACT

The invention is directed to reinforced ground cover mats which can be used to facilitate the passage of heavy equipment and vehicles on wet or disturbed ground. The ground cover mats are comprised of boards contained within a metal frame. A structural support in the form of an I-beam encases the boards and frame on one side, and a tubular member such as a pipe on the other side, thereby increasing the strength at the middle of the mat ends. Further, the tubular member can be modified at its ends to facilitate insertion of a sling and stacking of adjacent mats. The mat also comprises means for lifting, including passages through which chains or cable may be threaded, lifting shackle assemblies or pear link assemblies.

20 Claims, 8 Drawing Sheets

FIG. 8a
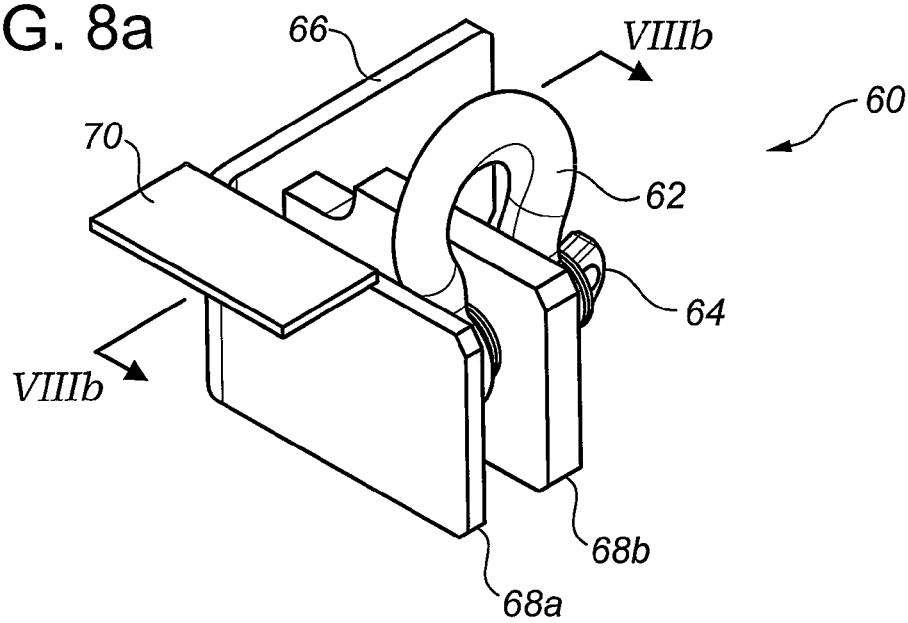
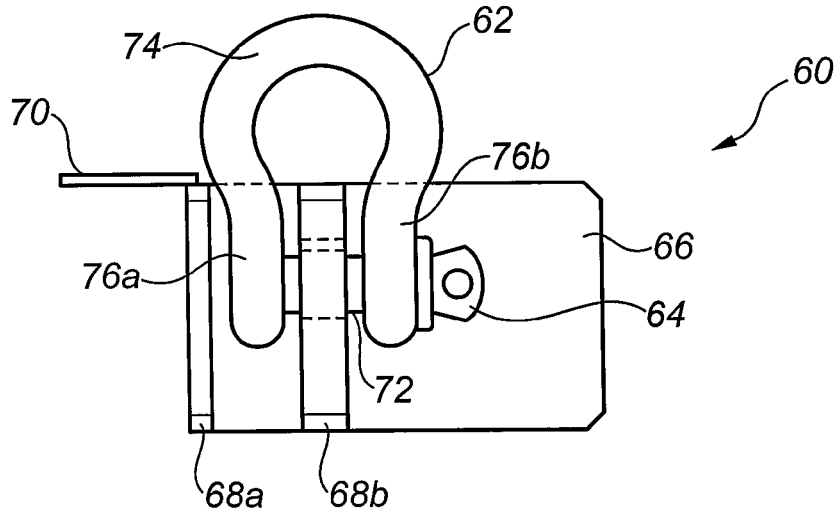
FIG. 8b

FIG. 8c
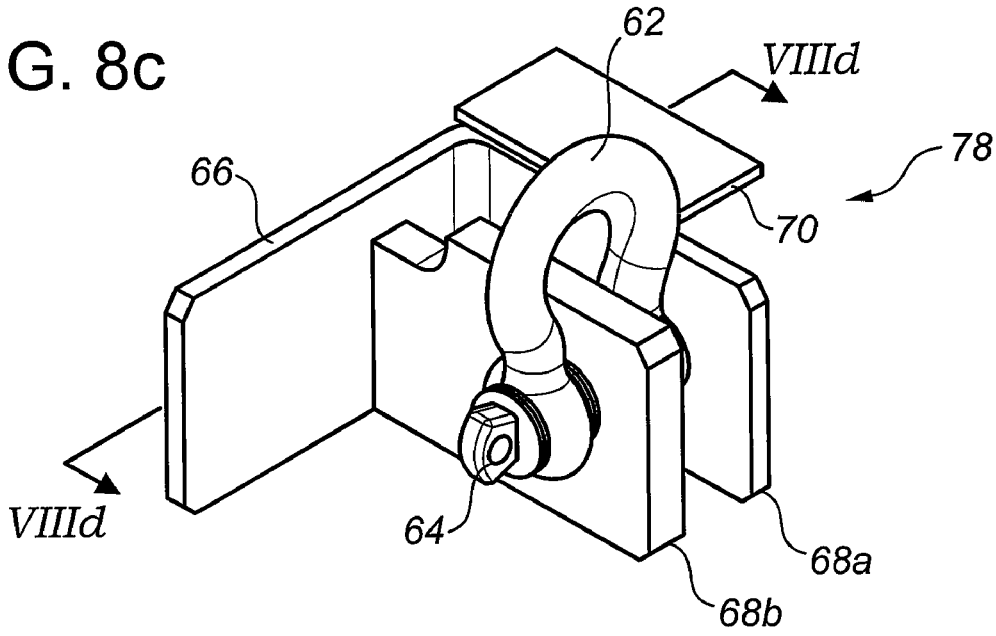
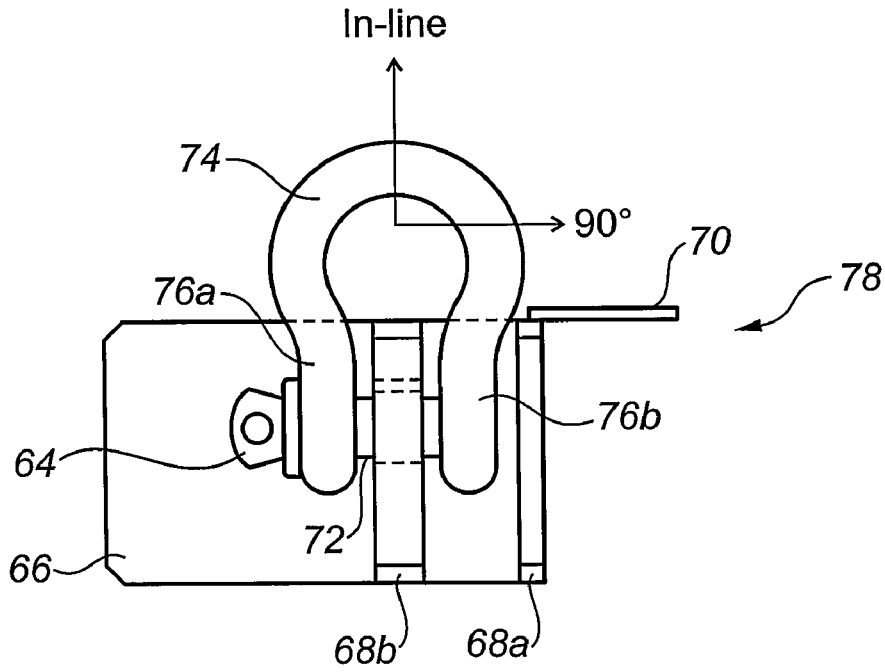
FIG. 8d

REINFORCED GROUND COVER MATS

FIELD OF THE INVENTION

The present invention relates to ground cover mats.

BACKGROUND OF THE INVENTION

In the oil and gas industry, it is sometimes necessary to provide ground cover mats with sufficient strength to support heavy equipment and transport trucks over wet or disturbed ground.

Several prior art ground cover mats exist; however, they lack sufficient reinforcement to withstand the pressure of heavy equipment and transport trucks, and are expensive to produce. What is needed is an improved ground cover mat which is simple and relatively inexpensive and has sufficient strength and durability to support heavy equipment.

Further, ground cover mats tend to be extremely heavy and lengthy, making the mats difficult to store, lift, transport, assemble or disassemble. Since a series of mats are generally required to construct a temporary road, an improved ground cover mat which is easy to handle is desirable.

There have been attempts in the prior art to solve such problems. For example, U.S. Pat. No. 4,462,712 issued Jul. 31, 1984 to Penland, Sr. describes an interlocking mat assembly comprising assemblies of two-ply laminated mats which interlock and are secured together by nailing a top layer of planks over the interlocked mats. However, this mat assembly is particularly labor intensive.

Canadian Patent No. 1,285,166 issued Jun. 25, 1991 to Pouyer describes a temporary road which includes a plurality of sets, each defined by upper and lower matrices with the upper matrices comprising boards and the lower matrices comprising cross-support members for supporting the boards. The road is constructed by interlocking series of sets in a superimposed assembly, necessitating significant redundancy of effort in assembly and disassembly.

U.S. Pat. No. 6,695,527 issued Feb. 24, 2004 to Seaux et al. describes interlocking mats constructed of two mirror half pieces which are joined together to form a complete single mat containing an internal cellular structure. Traction promoting elements in the form of raised strips extending outward from the planar surfaces of the mats and aligned with the internal cell forming walls are provided to improve traction and to absorb heavy loading from vehicles and equipment. However, Seaux et al. indicates that when a large number of the raised strips are not specifically positioned in such a manner, the relatively thin outer skin defining the roughly planar surfaces of the mats can become easily deformed by such direct loading.

U.S. Pat. Nos. 4,600,336 and 5,087,149 issued Jul. 15, 1986 and Feb. 11, 1992 respectively, to Waller describe mat systems having individual mats with alternating offset extensions and recesses along the edges. These systems are disadvantageous in that the offset extensions are comprised of individual planks which may be subject to warping or splintering when exposed to heavy loads. Further, the offset extensions need to be nailed in place to be secured within the recess of an adjacent mat. An extra plank is secured over the exposed nailed joints of adjacent mats to interlock the mat assemblies together as a roadway, which significantly increases material and labor requirements.

Canadian Patent No. 2,348,328 issued Oct. 22, 2002 to Stasiewich et al describes a road mat including, at both of its ends, couplings having retaining lips which engage complimentary retaining lips of adjacent mats to prevent separation when weight applied by a vehicle to one road mat is transferred to an adjacent road mat. Canadian Patent No. 2,364,968 issued Jun. 22, 2004 to Stasiewich et al describes a road mat having end and side interlocks to secure adjacent mats. However, there is no provision in either patent of details regarding attachment of the retaining lips to the mat ends, or the use of any reinforcing structural support.

Therefore, there is a need in the art for an improved ground cover mat which has sufficient strength to support heavy equipment, provides easy handling, and is simple and relatively inexpensive.

SUMMARY OF THE INVENTION

The present invention is directed to ground cover mats. In one aspect of the invention, the invention comprises a ground cover mat comprising:

(a) a quadrilateral frame comprised of:
  (i) two substantially parallel opposing end members, each such end member having an inner slot facing the opposing end member and an outer slot facing away from the opposing end member; and
  (ii) two substantially parallel opposing lateral members each having an inner slot;

whereby the four comers of the quadrilateral frame comprise a joint between one end of a lateral member and one end of an end member;

(b) a plurality of elongate boards retained within the frame, the frame and the boards collectively forming two opposing major surfaces, and whereby said boards insert into, and are retained by the inner slots of the end members or the lateral members, or both the end members and the lateral members; and (c) a tubular member attached at each end of the mat, whereby each tubular member inserts into, and is retained by the outer slots of the end members.

In one embodiment, each end member is an I-beam comprising a vertical web and upper and lower horizontal flanges connected to opposite ends of the vertical web, said horizontal flanges and vertical web forming the inner and outer slots. In one embodiment, each lateral member has a slot facing the opposing lateral member, and wherein the elongate boards insert into, and are retained by the slots in the lateral members. In one embodiment, the tubular members are longer than the end members and project beyond each end of the end members, and wherein each end of the tubular member has a flanged cap extending beyond the diameter of the tubular member. In one embodiment, the end of each tubular member is tapered such that there is a gap between the tubular member and one of the major surfaces. In one embodiment, a recess in the ends of each lateral member allows access to the flange capped ends of the tubular members. In one embodiment, at least one of the horizontal flanges forming the outer slot of each end member is bent at an angle towards the opposing horizontal flange.

In one embodiment, the boards are retained within the frame in an orientation that is substantially parallel to the end members. In one embodiment, the boards are retained within the frame in an orientation that is substantially perpendicular to the end members. In one embodiment, each elongate board comprises a board having a substantially rectangular cross-section and disposed such that the vertical dimension is larger than the horizontal dimension. In one embodiment, each elongate board comprises at least one wood layer bonded to at least one composite material layer.

In one embodiment, the frame further comprises a mid rail comprising a structural support member being connected at each end to the mid point of each end member in an orientation that is substantially parallel to each lateral member. In one embodiment, the ends of the mid rail insert into, and are retained within the inner slots of the end members. In one embodiment, the mid rail has slots facing the lateral members, and wherein the elongate boards insert into, and are retained by the slots on the mid rail. In one embodiment, a plurality of cross-beam support members are arranged in an orientation that is substantially parallel to the opposing end members, each cross-beam support member being connected at one end to the mid rail and at the other end to a lateral member.

In a further embodiment, the mat comprises means for lifting disposed on at least one of the major surfaces. In one embodiment, the means for lifting comprises at least two passages, each such passage extending from an opening on a major surface proximate to a lateral member, to an opening in the outer surface of the lateral member. In one embodiment, the means for lifting comprises a lifting shackle assembly, the assembly comprising a lifting shackle, closure means, a front wall, and parallel spaced outer and inner side walls which extend from the front wall and are spaced apart at a distance sufficient to accommodate the lifting shackle. In one embodiment, the outer side wall has an attachment plate protruding outwardly from its upper surface for holding a board or a cross-beam member. In one embodiment, the inner side wall has a thickness greater than that of the outer side wall, and a bore through which the closure means can extend to anchor the lifting shackle. In one embodiment, the lifting shackle is generally U-shaped, having a bow portion and arms with eyelets for insertion of the closure means. In one embodiment, the closure means is selected from a screw pin, a round pin, an alloy screw pin, an alloy round pin, or a bolt and nut with a cotter pin.

In yet a further embodiment, the means for lifting comprises a pear link assembly, the assembly comprising a pear link, two opposing side walls, a retaining bar anchored between the opposing side walls, and two opposing end walls, the side wall defining a bore which aligns with a complimentary bore on the opposing side wall for insertion of the retaining bar, and the pear link being pivotally mounted on the retaining bar. In one embodiment, the side wall has a notch formed therein for allowing drainage of water or mud.

BRIEF DESCRIPTION OF THE DRAWINGS

The invention will now be described by way of an exemplary embodiment with reference to the accompanying simplified, diagrammatic, not-to-scale drawings.

FIG. 8*a* is an enlarged view of a partially cut away section of a mat of FIG. 8, showing the detail of a left lifting shackle assembly.

FIG. 8*b* is a cross-sectional view taken along line 8*b*-8*b* of FIG. 8*a*, showing the detail of the left lifting shackle assembly.

FIG. 8*c* is an enlarged view of a partially cut away section of a mat of FIG. 8, showing the detail of a right lifting shackle assembly.

FIG. 8*d* is a cross-sectional view taken along line 8*d*-8*d* of FIG. 8*c*, showing the detail of the right lifting shackle assembly.

DETAILED DESCRIPTION OF THE INVENTION

Figure 1:
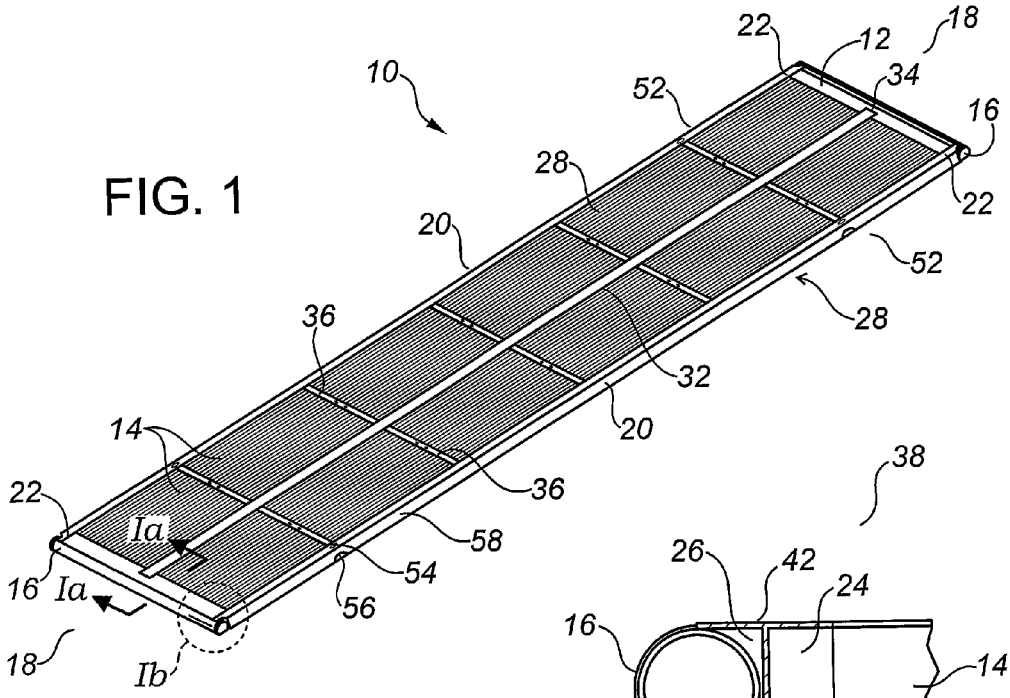
FIG. 1 is a diagrammatic representation of a mat of one embodiment of the present invention.

The present invention provides for reinforced ground cover mats. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

The invention will now be described having regard to the accompanying Figures. The mat (10) is comprised of a quadrilateral frame (12), a plurality of elongate boards (14) and a tubular members (16).

The quadrilateral frame (12) comprises two substantially parallel opposing end members (18) and two substantially parallel opposing lateral members (20). The four comers of the frame (12) comprise a joint (22) between one end of a lateral member (20) and one end of an end member (18). The frame may be rectangular, or a parallelogram, or trapezoidal. The exact geometry of the frame is not essential to the invention. Each end member (18) has an inner slot (24) facing the opposing end member (18) and an outer slot (26) facing away from the opposing end member (18). In one embodiment, the end member (18) comprises an I-beam, and the inner and outer slots (24, 26) comprise the slots formed by the I-beam. Each lateral member (20) has a slot (not shown) facing the opposing lateral member (20). In one embodiment, the lateral member (20) comprises an I-beam or a C-channel type member.

In one embodiment, the elongate boards (14) are parallel to the lateral members (20) and are retained within the frame (12) by insertion into the inner slots (24) of the end members (18), as shown in FIG. 1 a. The boards (14) collectively form two opposing major surfaces (28). The tubular member (16) is attached at each end of the mat (10) in an orientation parallel to the end member. Each tubular member (16) inserts into, and is retained by the outer slots (26) of the end members (18).

Figure 1A:
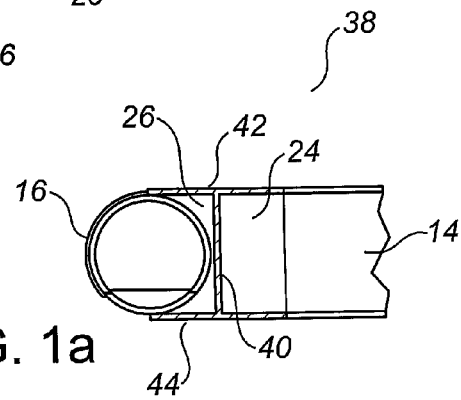
FIG. 1*a* is a cross-sectional view taken along line 1*a*-1*a* of FIG. 1, showing the detail of an I-beam and a tubular member.
Figure 1B:
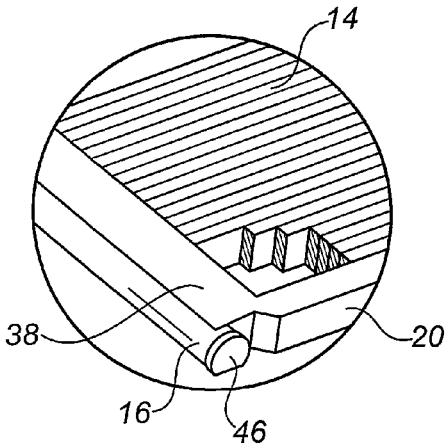
FIG. 1*b* is an enlarged view of a partially cut away section of a mat of FIG. 1, showing the detail of a board, an I-beam and a tubular member.

In one embodiment, the boards (14) are retained within the frame (12) in an orientation that is substantially perpendicular to the end members (18) (FIGS. 1 and 1*b*). In one embodiment, each board (14) has a substantially rectangular cross-section and is disposed such that the vertical dimension of the board (14) is larger than the horizontal dimension, thus increasing the bending strength of the mat (10). The boards (14) may comprise conventional 2×4 or 2×6 lumber or may be constructed using wood layers bonded to composite material layers. In one embodiment, a board comprises at least one wood layer bonded to at least one composite material layer. As used herein, the term "composite" refers to any engineered material made from two or more constituent materials with significantly different physical or chemical properties and which remain separate and distinct on a macroscopic level within the finished structure. In one embodiment, the composite material layers may comprise fiberglass; however, such other materials as are commonly used in the art may also be employed for the boards (14).

Figure 1C:
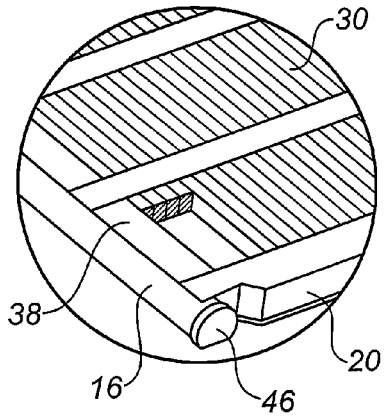
FIG. 1*c* is a diagrammatic representation of a partially cut away section of a mat, showing the detail of a plurality of cross-beam members, an I-beam and a tubular member.

In another embodiment, the boards (14) comprise a plurality of cross-beam members (30) arranged in an orientation that is parallel to the end members (18) (FIG. 1*c*). The cross-beam members (30) may comprise 6×6 timbers or other suitable materials as are commonly known in the art.

The frame (12) is constructed from any suitable material such as steel. The frame (12) preferably includes a mid rail (32) comprising a structural support member (34) oriented substantially parallel to each lateral member (20), and which is connected at each end to the mid point of each end member (18). The ends of the mid rail (32) insert into, and are retained by the inner slots (24) of the end members (18). The mid rail (32) has slots (not shown) facing the lateral members (20). If the boards are parallel to the mid rail (32), the mid rail slots will retain at least one of the boards (14). A plurality of cross-beam support members (36) are arranged perpendicular to the lateral members (20) and the boards (14). Each cross-beam support member (36) is connected at one end to the mid rail (32) and at the other end to a lateral member (20), and defines slots to receive boards (14). Therefore, each cross-beam support member (36) is preferably an I-beam.

The mat (10) is specially configured at its end members (18) to provide strength and to enable easy stacking of mats (10) as described below.

Figure 4:
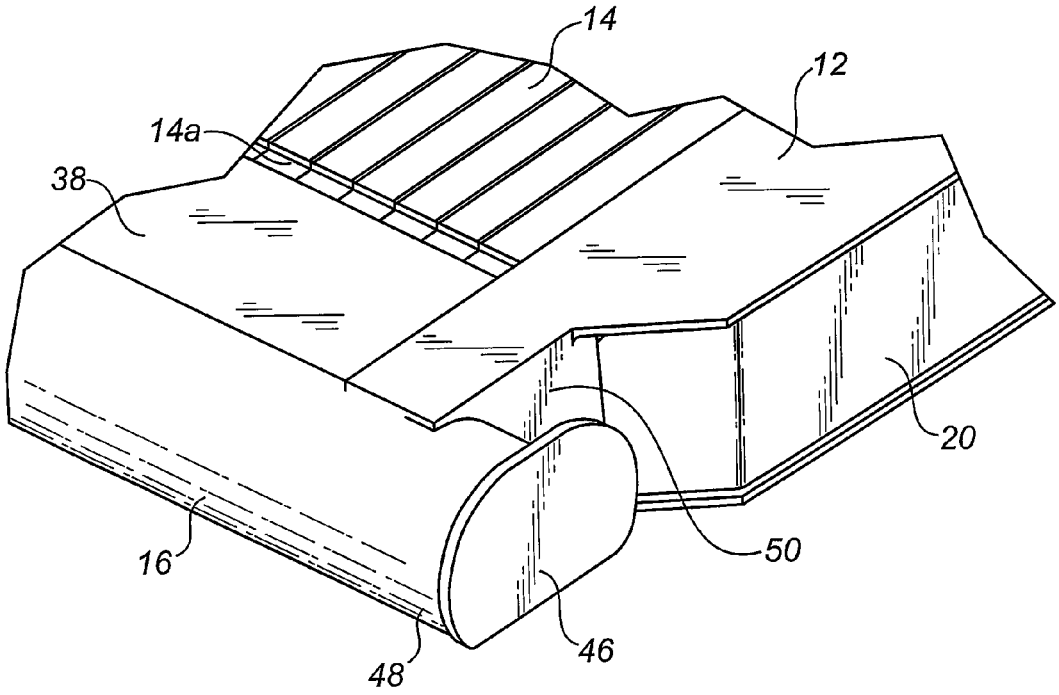
FIG. 4 is a diagrammatic depiction of a portion of an end member of one embodiment of a mat of the present invention.
Figure 5:
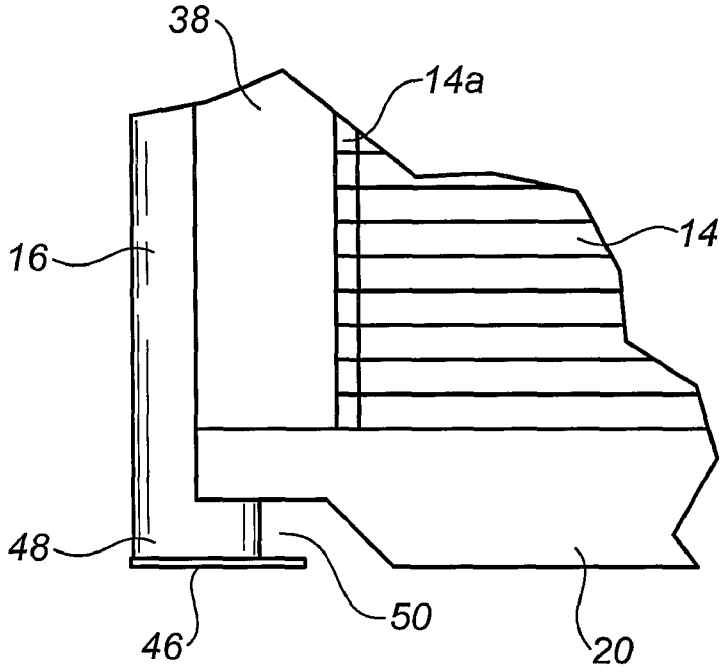
FIG. 5 is a diagrammatic representation of a top view of a portion of an end member of one embodiment of the present invention.

As shown in FIGS. 1, 4 and 5, each end member (18) comprises an I-beam (38) comprising a vertical web (40) and upper and lower horizontal flanges (42, 44). The upper and lower horizontal flanges (42, 44) and vertical web (40) form the inner and outer slots (24, 26). As used herein, the terms "upper" and "lower" refer to the I-beam when in the orientation shown for example in FIG. 1*a*. However, the artisan will recognize that the I-beam can adopt any particular orientation when in use.

The I-beam (38) is sized to accommodate the boards (14) or cross-beam members (30), and the tubular member (16) accordingly. The I-beam (38) has a length which does not extend past the edges of the lateral members (20). In one embodiment, the width of the I-beam (38) is substantially identical to the width of the board (14), as shown in FIGS. 1 and 1*a*. In one embodiment, the boards (14) may be notched (14*a*) to accommodate the I-beam (38) when the height of the inner slot (24) is less than the height of the board (14), as shown in FIGS. 4 and 5. The I-beam (38) may be formed of structural steel or other suitable materials commonly used in the art.

The I-beam (38) is positioned perpendicular to the lateral members (20) so as to engage the boards (14) (see FIG. 1*b*) or cross-beam members (30) (see FIG. 1*c*) with its inner slot, and the tubular member (16) with its outer slot. The boards (14) or cross-beam members (30) are compressed by the upper and lower horizontal flanges (42, 44) of the I-beam (38). The I-beam (38) is joined to the tubular member (16) by welding or other suitable techniques commonly used in the art.

As shown in FIG. 1, in one embodiment, the tubular members (16) are longer than the end members (18) and project beyond each end of the end members (18). In one embodiment, the tubular members (16) do not extend beyond the outside edge of each lateral member (20) so that they do not impinge on adjacent mats.

Figure 3:
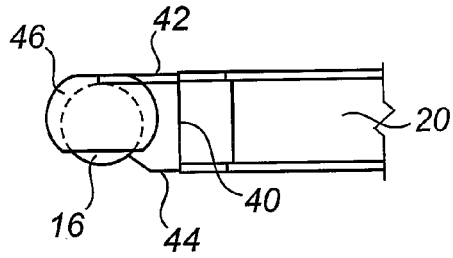
FIG. 3 is a diagrammatic representation of a side view of a tubular member of one embodiment of the present invention.
Figure 7:
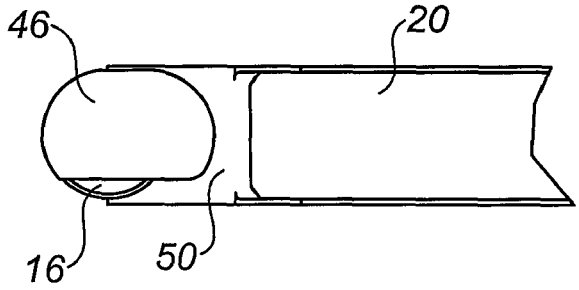
FIG. 7 is a diagrammatic representation of a side view of the end member and a portion of a lateral member of one embodiment of the present invention.

Each end of the tubular member (16) has a flanged cap (46) extending beyond the diameter of the tubular member (18). In one embodiment, the flanged cap (46) may cap the entirety of the tubular member end (16) as shown in FIGS. 1 and 1*b*, or a portion thereof as shown in FIGS. 3 and 7. In one embodiment, the flanged cap (46) is formed substantially in the shape of a semi-circle. The flanged cap (46) is constructed of steel or other suitable materials commonly used in the art, and is attached to each tubular member end (16) by welding or other techniques commonly used in the art.

Figure 2:
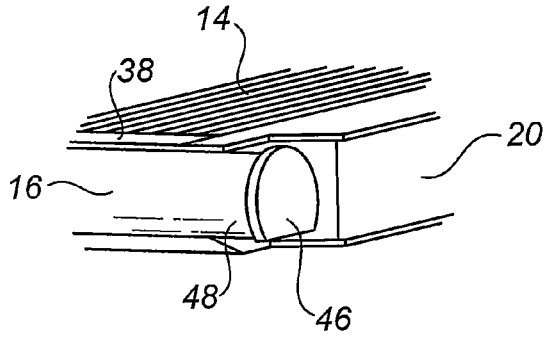
FIG. 2 is a diagrammatic representation of a side view of a tubular member of one embodiment of the present invention.
Figure 6:
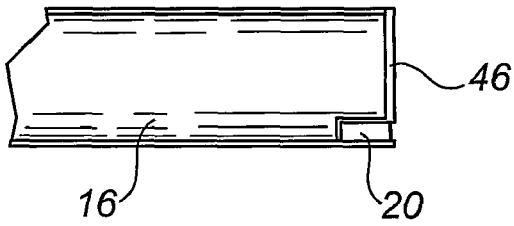
FIG. 6 is a diagrammatic representation of a side view of the end portion of a tubular member of one embodiment of the present invention.

In one embodiment, the tubular member (16) is sized to fit fully against the vertical web (40) and between the upper and lower horizontal flanges (42, 44) of the I-beam (38), as shown in FIG. 1*a*. Each end (48) of the tubular member (16) is tapered, such that there is a gap between the tubular member (16) and one of the major surfaces (28) to facilitate insertion of the sling (not shown) for lifting the mat (10) as shown in FIGS. 2 and 6.

As shown in FIGS. 4, 5 and 7, a notch or recess (50) in the ends of each lateral member (20) is provided for allowing access to the flange capped ends (48) of the tubular members (16). It can be understood that to lift the mat, a sling (not shown) may be looped around the flanged cap ends (48) of each of the tubular members (16) and is then drawn tight.

In one embodiment, at least one of the horizontal flanges (42, 44) forming the outer slot (26) of each end member (18) is bent at an angle towards the opposing horizontal flange (42, 44) to contact the tubular member (16), thereby securing the tubular member (16) between the horizontal flanges (42, 44). In one embodiment, the horizontal flange (44) of the I-beam (38) is bent at an angle towards the opposing horizontal flange (42) and welded to the tubular member (16), as shown in FIG. 3. In this embodiment, the tubular member (16) will have a diameter less than the height of the end member (18).

The above described invention provides several advantages. Notably, the arrangement of the I-beam (38) to encase the board (14) or cross-beam members (30) on one side, and the tubular member (16) on the other side significantly reinforces the mat (10), increasing the strength at the middle of the mat ends in comparison to a conventional mat, such that the mat may better support heavy equipment. This arrangement is contrary to conventional mats in which a frame is commonly secured to an I-beam by a plate welded overtop of both components, rather than being encompassed by same.

Further, the modified ends of the tubular members (16) facilitate not only insertion of the sling for lifting one or more mats (10), but also stacking of adjacent mats (10) for lifting, shipping or storage. As may be seen, because the tubular members have a smaller diameter than the height of the end members, a sling may be fit around the tubular member end caps even while the mats (10) are stacked together.

The mats (10) of the present invention may be easily lifted and moved using conventional oilfield equipment. Various lifting means may be incorporated with the mats (10). In one embodiment shown in FIG. 1, the means for lifting comprises at least two passages (52). Each passage (52) extends from an opening (54) on a major surface (28) proximate to a lateral member (20), to an opening (56) in the outer surface (58) of the lateral member (20). Chains or cable (not shown) may be threaded through the openings (54, 56) and corresponding passages (52) to facilitate the use of lifting equipment such as a picker or crane.

Figure 8:
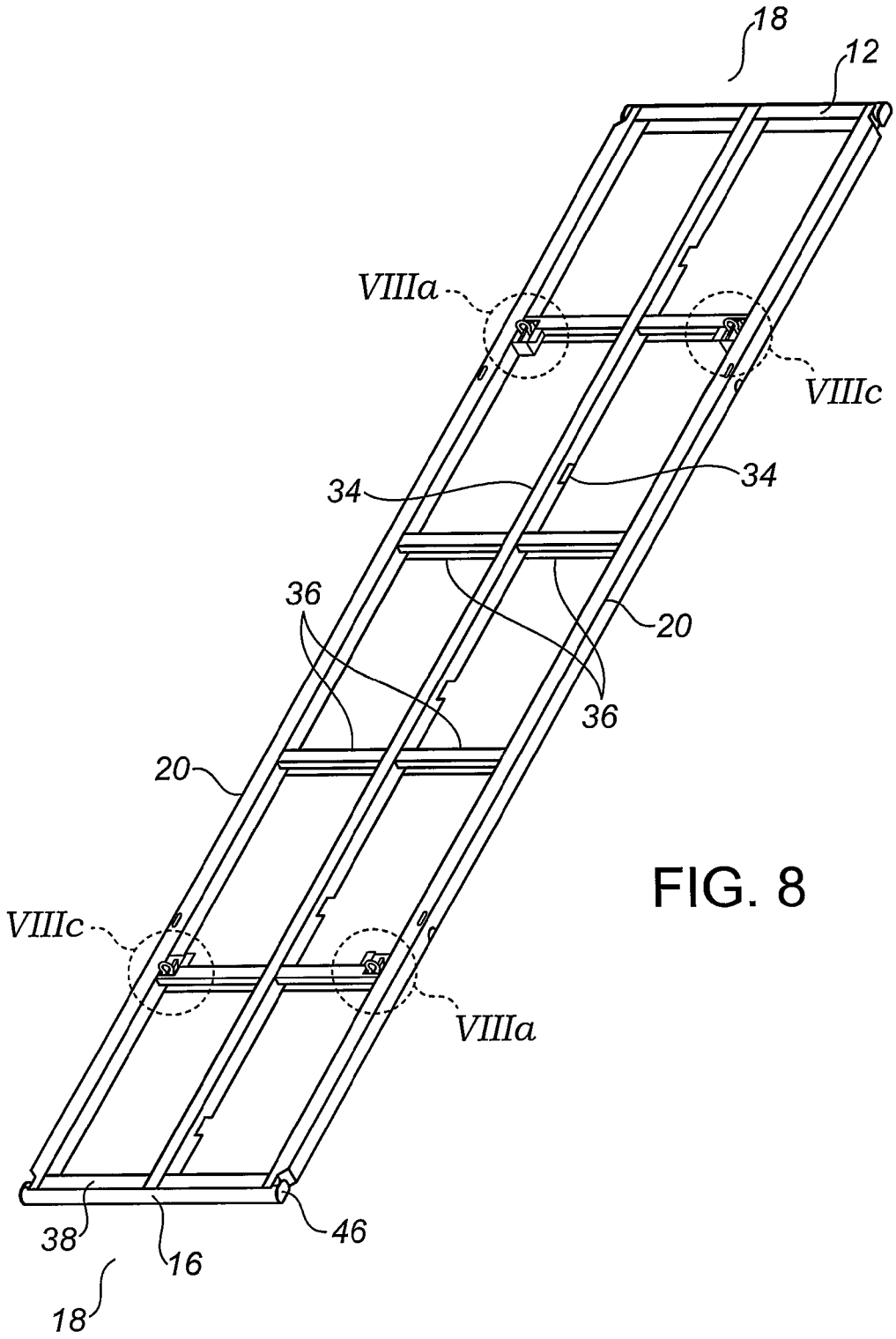
FIG. 8 is a diagrammatic depiction of one embodiment of a mat of the present invention.

In another embodiment shown in FIG. 8, the means for lifting comprises lifting shackle assemblies. The left lifting shackle assembly (60) comprises a lifting shackle (62), closure means (64), a front wall (66), and parallel spaced outer and inner side walls (68*a*, 68*b*) which extend from the front wall (66). The outer and inner side walls (68*a*, 68*b*) are spaced apart at a distance sufficient to accommodate the lifting shackle (62). The outer side wall (68*a*) has an attachment plate (70) protruding outwardly from its upper surface for holding the board (14) or cross-beam member (30). The inner side wall (68*b*) has a thickness greater than that of the outer side wall (68*a*) in order to withstand the forces applied during lifting of the mat (10). The inner side wall (68*b*) has a bore (72) through which the closure means (64) can extend to anchor the lifting shackle (62).

The lifting shackle (62) is generally U-shaped, having a bow portion (74) and arms (76*a*, 76*b*) with eyelets (not shown) for insertion of the closure means (64). Suitable closure means (64) include, for example, a screw pin, round pin, alloy screw pin, alloy round pin, or a bolt and nut with a cotter pin. In one embodiment, the closure means (64) is rated to align with the line of lift, thereby avoiding weakening or bending of the closure means (64) (for example, a pin) as commonly encountered in conventional designs. When installed, the closure means (64) extends through the arm (76*b*) and the complimentary bore (72) of the inner side wall (68*b*) to contact the opposing arm (76*a*). The lifting shackle (62) extends upwardly to enable the threading of chains, cables, hooks or slings to facilitate lifting of the mat (10).

The lifting shackle (62) can be any shackle appropriate for general lifting purposes. The lifting shackle (62) can be formed of any suitable material, although for strength, the lifting shackle (62) may be formed of forged steel, hardened steel, stainless steel, carbon, alloy and the like. In one embodiment, the shackles are quenched and tempered to withstand cold and adverse field conditions. Quenching and tempering maximizes the properties of the shackle including, for example, its rated strength, ductility, toughness, impact strength and fatigue resistance. The shackles may also have a design factor which is at minimum 5:1. The design factor is computed by dividing the ultimate load by the working load limit. The ultimate load is the average load or force at which the shackle fails or no longer supports the load. The working load limit is the maximum mass or force which the shackle is authorized to support. Non-limiting examples of suitable shackles include an 8.5 tonne generic rated shackle, a 9.5 tonne generic rated shackle or other appropriate shackle commonly used in the art. In one embodiment, the lifting shackle (62) is a forged anchor shackle with a screw pin, as shown in FIGS. 8*a* and 8*b*.

FIGS. 8*c* and 8*d* show a right lifting shackle assembly (78) which shares the same features as the left lifting shackle assembly (60) and to which the same description applies. As shown in FIG. 8, multiple left and right lifting shackle assemblies (60, 78) are incorporated at the edges of the frame (12) to facilitate lifting of the mat (10). The frame (12) may be recessed to accommodate the lifting shackle assemblies (60, 78). The lifting shackle assemblies (60, 78) are oriented with the lifting shackles (62) being positioned parallel to the lateral surfaces (20) and perpendicular to the end members (18). This orientation enables the lifting shackle (62) to lift within the plane of the bow portion (74) as indicated in FIG. 8*d*. The attachment plates (70) hold the boards (14) or cross-beam members (30). The front walls (66) are attached to the frame (12) by welding or other suitable technique.

As shown in the Figures, each of the left and right lifting shackle assemblies (60, 78) is molded as a monolithic unit combining the lifting shackle (62), the closure means (64), the front wall (66), the outer and inner side walls (68*a*, 68*b*) and the attachment plate (70). However, those skilled in the art will understand that various modifications can be made without altering the substance of the invention. For example, the shackle (62) with the closure means (64) can be manufactured either as an integral component of the lifting shackle assembly (60, 78) or as a separate component to be attached to the lifting shackle assembly (60, 78).

Figure 9:
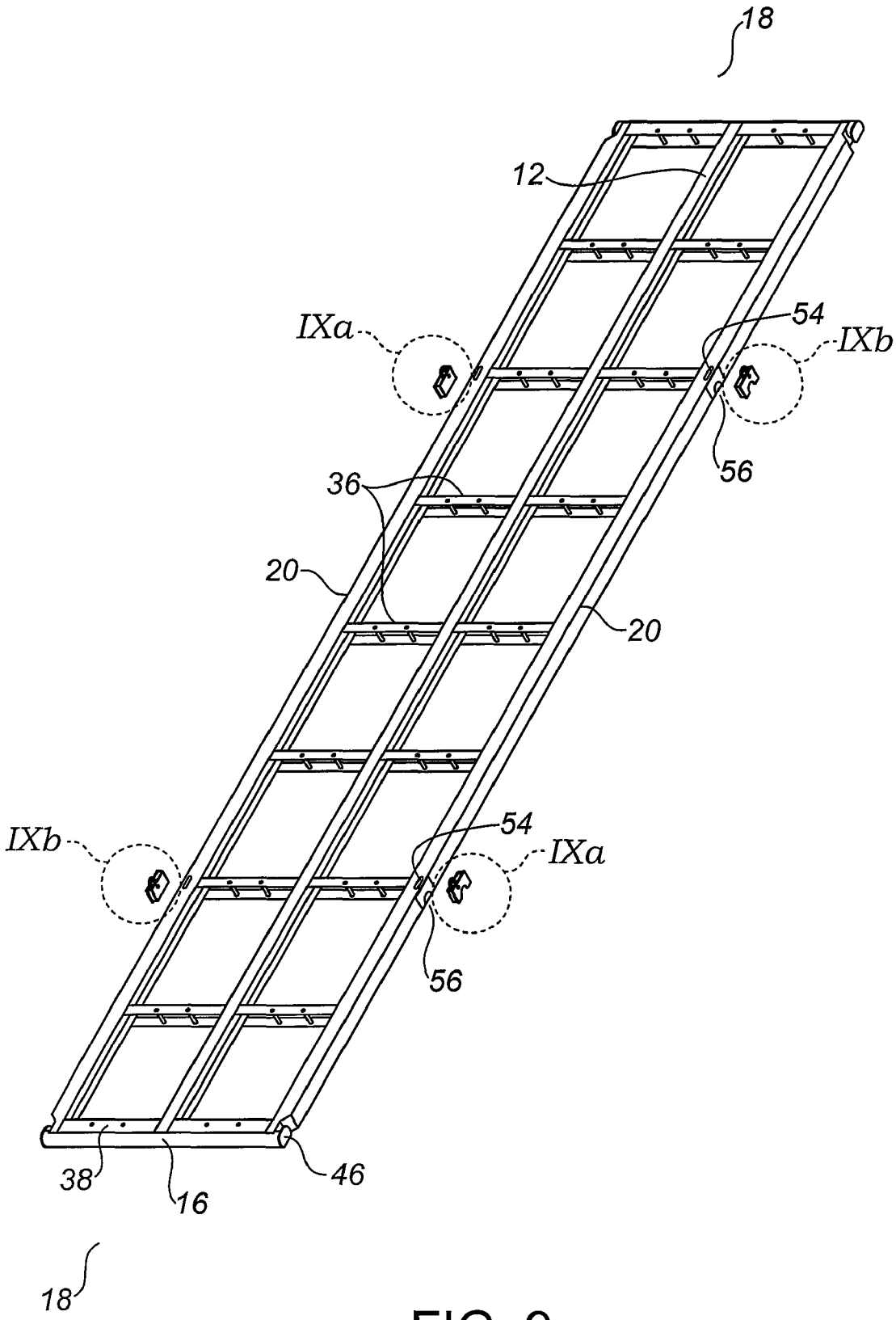
FIG. 9 is a diagrammatic depiction of one embodiment of a mat of the present invention.

In a further embodiment, the means for lifting comprises pear link assemblies. Simply for ease of description, FIG. 9 shows installation of pear link assemblies before insertion and welding within the edges of the frame (12) to align with the openings (54, 56) and passage (52). In another embodiment (not shown), lifting pear link assemblies may be incorporated as portions of the cross beam support members (36).

Figure 9A:
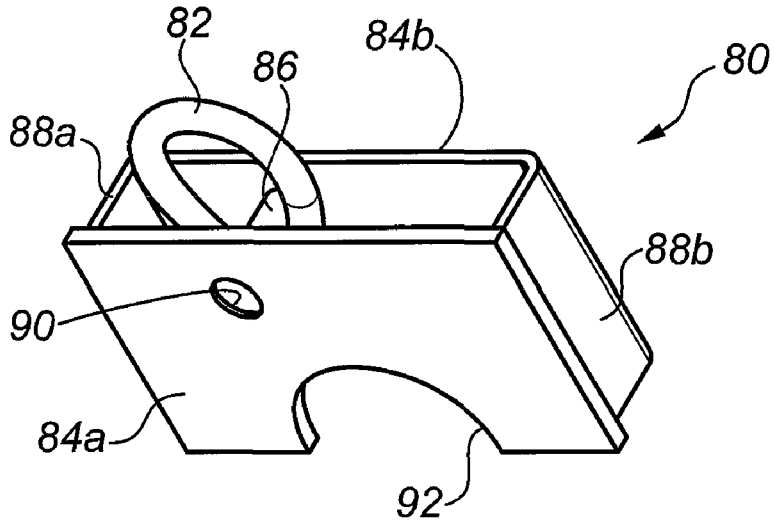
FIG. 9*a* is an enlarged view of a partially cut away section of a mat of FIG. 9, showing the detail of a left pear link assembly.

As shown in FIG. 9*a*, the left pear link assembly (80) comprises a pear link (82), two opposing side walls (84*a*, 84*b*), a retaining bar (86) anchored between the opposing side walls (84*a*, 84*b*), and two opposing end walls (88*a*, 88*b*). The side wall (84*a*) defines a bore (90) which aligns with a complimentary bore (not shown) on the opposing side wall (84*b*) for insertion of the retaining bar (86). In one embodiment, the retaining bar (86) is rated to align with the line of lift, thereby avoiding weakening or bending of the retaining bar. Further, the side wall (84*a*) has a notch (92) formed therein for allowing drainage of water or mud, for example, as the mat (10) is lifted from its immersion within the ground or when the mat (10) is rinsed following use.

The pear link (82) can be any rated pear link appropriate for general lifting purposes as commonly used in the art. The pear link (82) can be formed of any suitable material, although for strength, the pear link (82) may be formed of forged steel, hardened steel, stainless steel, carbon, alloy or the like. In one embodiment, the pear link (82) may have a working load limit of at least 4000 lbs or greater.

Although not shown in the Figures, it will be understood by those skilled in the art that pear links generally have a narrow end and a wide end. In one embodiment of the present invention, the pear link (82) is pivotally mounted at its narrow end on the retaining bar (86) which is anchored between the side walls (84*a*, 84*b*) by welding or other technique. The wide end of the pear link (82) protrudes upwardly above the side walls (84*a*, 84*b*) and end walls (88*a*, 88*b*) to enable threading of chains, cables, hooks or slings to facilitate lifting of the mat (10).

Figure 9B:
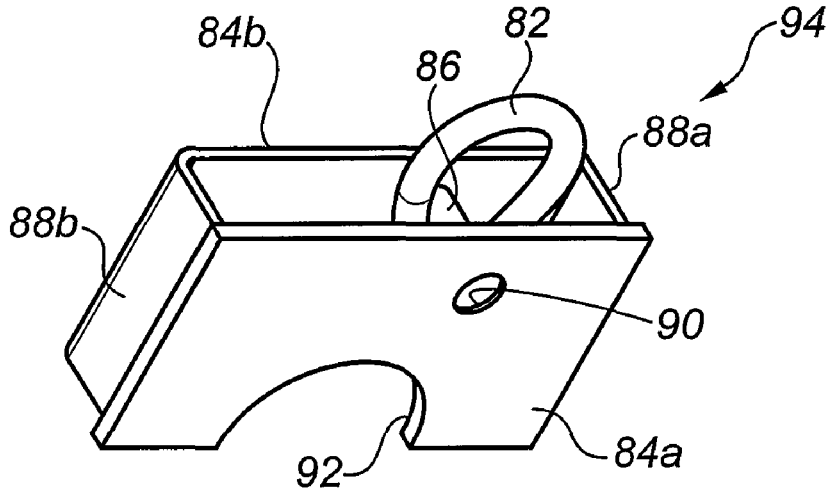
FIG. 9*b* is an enlarged view of a partially cut away section of a mat of FIG. 9, showing the detail of a right pear link assembly.

FIG. 9*b* shows a right pear link assembly (94) which shares the same features as the left pear link assembly (80) and to which the same description applies. As shown in FIG. 9, multiple left and right pear link assemblies (80, 94) are inserted and welded within the edges of the frame (12), with each notch (92) in alignment with the corresponding passage (52), and the wide end of each pear link (82) protruding through the respective opening (54) to facilitate lifting of the mat (10).

As shown in the Figures, each of the left and right pear link assemblies (80, 94) is molded as a monolithic unit. However, those skilled in the art will understand that various modifications can be made without altering the substance of the invention. For example, the pear link (82) can be manufactured either as an integral component of the pear link assembly (80, 94) or as a separate component to be attached to the pear link assembly (80, 94).

What is claimed is:

1. A ground cover mat comprising:

(a) a quadrilateral frame comprised of:

(i) two substantially parallel opposing end members, each such end member having an inner slot facing the opposing end member and an outer slot facing away from the opposing end member, said end members each comprising an I-beam comprising a vertical web and upper and lower horizontal flanges connected to opposite ends of the vertical web, said horizontal flanges and vertical web forming the inner and outer slots; and (ii) two substantially parallel opposing lateral members, each, having an inner slot;

whereby the four corners of the quadrilateral frame comprise a joint between one end of a lateral member and one end of an end member;

(b) a plurality of elongate boards retained within the frame, the boards collectively forming two opposing major surfaces, and whereby said boards insert into, and are retained by the inner slots of the end members or the lateral members, or both the end members and the lateral members; and (c) a tubular member attached at each end of the mat, whereby each tubular member directly inserts into, and is retained by the outer slots of the I-beams, such that the tubular member contacts the vertical web and upper and lower horizontal flanges.

2. The mat of claim 1 wherein the tubular members are longer than the end members and project beyond each end of the end members, and wherein each end of the tubular member has a flanged cap extending beyond the diameter of the tubular member.

3. The mat of claim 2 wherein the diameter at each end of each tubular member is less than the height of the end member.

4. The mat of claim 3 further comprising a recess in the ends of each lateral member for allowing access to the flange capped ends of the tubular members.

5. The mat of claim 1 wherein at least one of the horizontal flanges forming the outer slot of each end member is bent at an angle towards the opposing horizontal flange.

6. The mat of claim 1 wherein the boards are retained within the frame in an orientation that is substantially parallel to the end members.

7. The mat of claim 1 wherein the boards are retained within the frame in an orientation that is substantially perpendicular to the end members.

8. The mat of claim 1 wherein each elongate board comprises a board having a substantially rectangular cross-section and disposed such that the vertical dimension is larger than the horizontal dimension.

9. The mat of claim 1 further comprising a mid rail, the mid rail comprising a structural support member being connected at each end to the mid point of each end member in an orientation that is substantially parallel to each lateral member.

10. The mat of claim 9 wherein the ends of the mid rail insert into, and are retained by the inner slots of the end members.

11. The mat of claim 9 wherein the mid rail has slots facing the lateral members, and wherein the elongate boards insert into, and are retained by the slots on the mid rail.

12. The mat of claim 9 further comprising a plurality of cross-beam support members arranged in an orientation that is substantially parallel to the opposing end members, each cross-beam support member being connected at one end to the mid rail and at the other end to a lateral member.

13. The mat of claim 1 further comprising means for lifting the mat, the means being disposed on one of the major surfaces.

14. The mat of claim 13 wherein the means for lifting comprises at least two passages, each such passage extending from an opening on a major surface proximate to a lateral member, to an opening in the outer surface of the lateral member.

15. The mat of claim 13 wherein the means for lifting comprises a lifting shackle assembly, the assembly comprising a lifting shackle, closure means, a front wall, and parallel spaced outer and inner side walls which extend from the front wall and are spaced apart at a distance sufficient to accommodate the lifting shackle.

16. The mat of claim 15 wherein the inner side wall has a thickness greater than that of the outer side wall, and a bore through which the closure means can extend to anchor the lifting shackle.

17. The mat of claim 16 wherein the outer side wall has an attachment plate protruding outwardly from its upper surface for holding a board or a cross-beam member.

18. The mat of claim 17 wherein the lifting shackle is generally U-shaped, having a bow portion and arms with eyelets for insertion of the closure means.

19. The mat of claim 13 wherein the means for lifting comprises a pear link assembly, the assembly comprising a pear link, two opposing side walls, a retaining bar anchored between the opposing side walls, and two opposing end walls, the side wall defining a bore which aligns with a complimentary bore on the opposing side wall for insertion of the retaining bar, and the pear link being pivotally mounted on the retaining bar.

20. The mat of claim 19, wherein the side wall has a notch formed therein for allowing drainage of water or mud.

* * * * *